US007472889B1

(12) United States Patent
Prather

(10) Patent No.: US 7,472,889 B1
(45) Date of Patent: Jan. 6, 2009

(54) VEHICLE LIFT SYSTEM

(76) Inventor: Thomas J. Prather, 541 Emerald St., Rock Springs, WY (US) 82901

( * ) Notice: Subject to any disclaimer, the term of this patent is extended or adjusted under 35 U.S.C. 154(b) by 0 days.

(21) Appl. No.: 11/867,828

(22) Filed: Oct. 5, 2007

(51) Int. Cl.
*B66F 3/18* (2006.01)

(52) U.S. Cl. ..... 254/103; 254/DIG. 4; 254/98; 254/DIG. 2

(58) Field of Classification Search ..... 254/103, 254/133 R, 102, 98, 425, 101, DIG. 4, DIG. 2
See application file for complete search history.

(56) References Cited

U.S. PATENT DOCUMENTS

| | | | | |
|---|---|---|---|---|
| 1,395,340 | A * | 11/1921 | Gormley | 254/103 |
| 3,645,501 | A | 2/1972 | Musgrove | |
| 3,997,143 | A | 12/1976 | Rose | |
| D287,239 | S | 12/1986 | Komatsu | |
| 4,749,169 | A | 6/1988 | Pickles | |
| 5,085,407 | A * | 2/1992 | Lonon | 254/103 |
| 5,118,082 | A * | 6/1992 | Byun | 254/102 |
| 5,211,375 | A | 5/1993 | Wang | |
| 5,707,043 | A * | 1/1998 | Yoshida | 254/126 |
| D396,927 | S | 8/1998 | Tersigni et al. | |
| 5,906,356 | A * | 5/1999 | Stratman | 254/103 |
| 5,915,672 | A * | 6/1999 | Dickey | 254/133 R |
| 5,992,826 | A * | 11/1999 | Simmonds | 254/103 |
| 6,685,169 | B2 * | 2/2004 | Shim | 254/103 |
| 6,942,196 | B1 | 9/2005 | Andrews | |

* cited by examiner

*Primary Examiner*—Lee D Wilson

(57) ABSTRACT

A vehicle lift system includes a vehicle with a power supply port. A housing has a bottom wall, a top wall and a peripheral wall. A sleeve extends upwardly from the housing. A piston is mounted in the sleeve. A drive assembly is mechanically coupled to the piston. The drive assembly is actuated in a first direction to raise an upper end of the piston with respect to the housing. The drive assembly is actuated in a second direction to lower the upper end of the piston with respect to the housing. The drive assembly is removably coupled to the power supply port to supply electrical power to the drive assembly. A plurality of engaging members is provided. One of the engaging members is removably attached to the upper end of the piston and engages the vehicle which the piston is raised.

8 Claims, 8 Drawing Sheets

VEHICLE LIFT SYSTEM

BACKGROUND OF THE INVENTION

Field of the Invention

The present invention relates to vehicle jack devices and more particularly pertains to a new vehicle jack device for lifting a portion of a vehicle, such as when the vehicle has a flat tire, by utilizing power from the vehicle.

SUMMARY OF THE INVENTION

The present invention meets the objectives presented above by generally comprising a vehicle that includes a power supply port. A housing has a bottom wall, a top wall and a peripheral wall attached to and extending between the top and bottom walls. A sleeve is attached to and extends upwardly from the housing. A piston is mounted in the sleeve. A drive assembly is mechanically coupled to the piston. The drive assembly is actuated in a first direction to raise an upper end of the piston with respect to the housing. The drive assembly is actuated in a second direction to lower the upper end of the piston with respect to the housing. The drive assembly is removably coupled to the power supply port to supply electrical power to the drive assembly. A plurality of engaging members is provided. One of the engaging members is removably attached to the upper end of the piston and engages the vehicle which the piston is raised.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
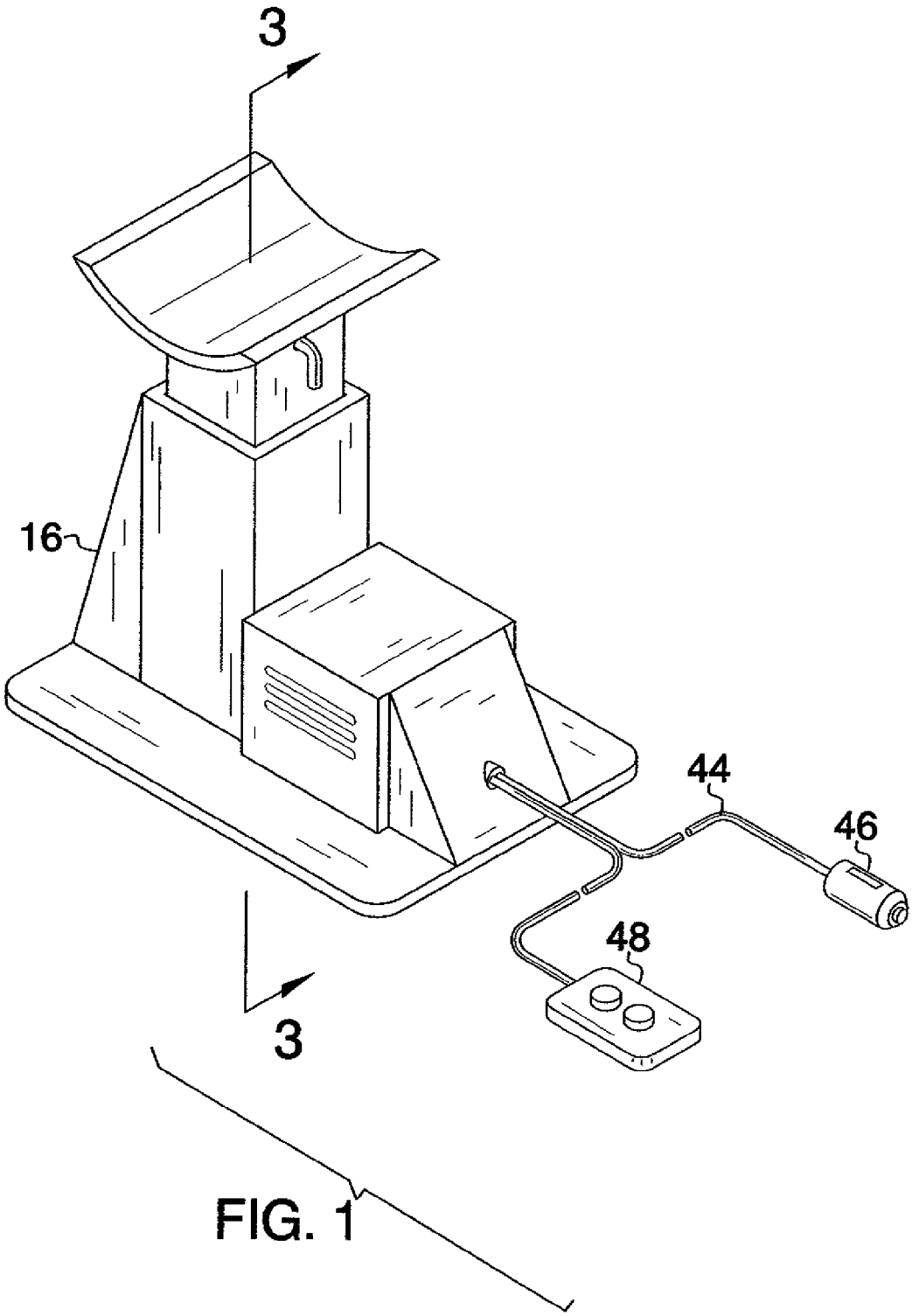
FIG. 1 is a perspective view of a vehicle lift system according to the present invention.
Figure 2:
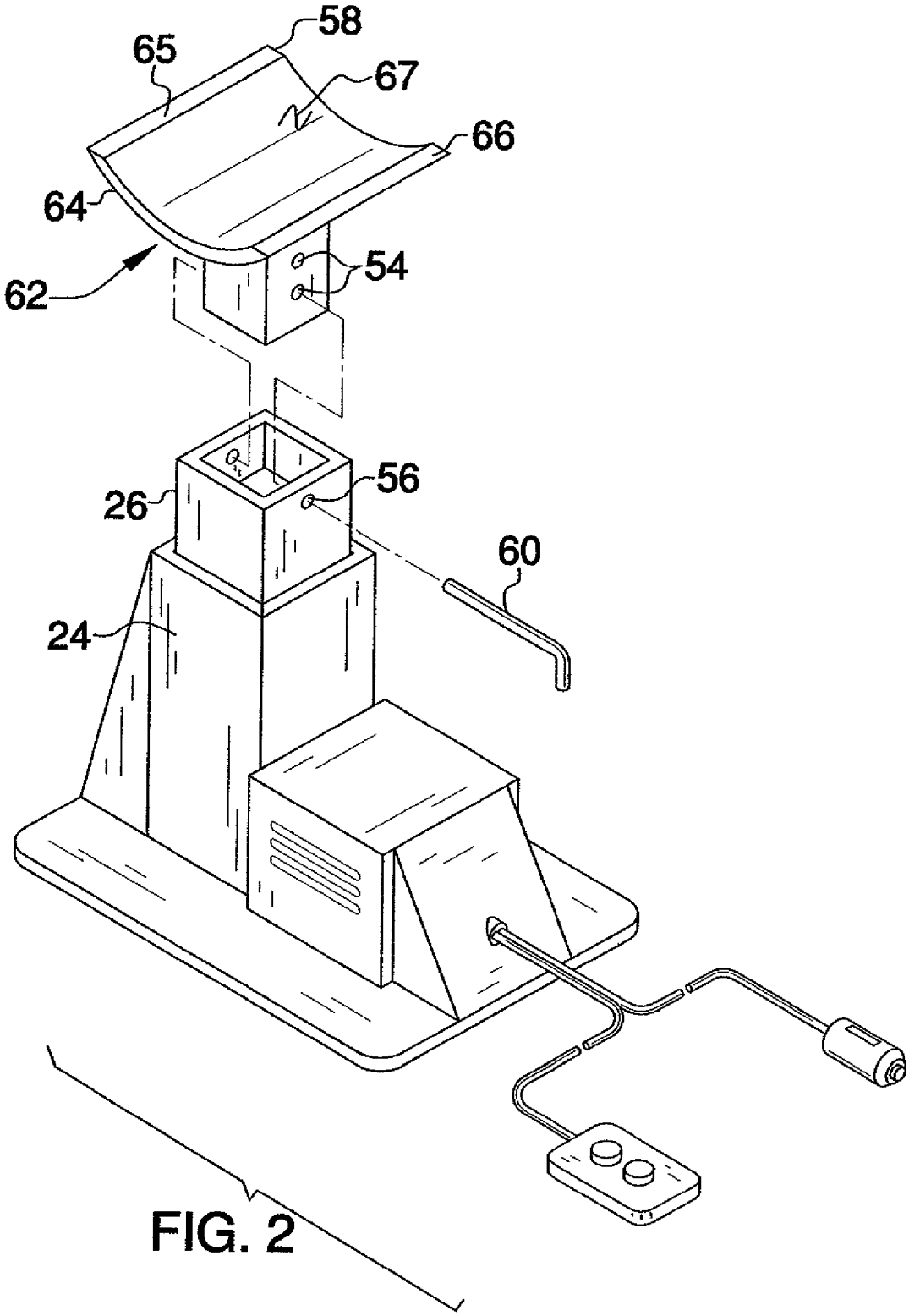
FIG. 2 is an expanded perspective view of the present invention.
Figure 3:
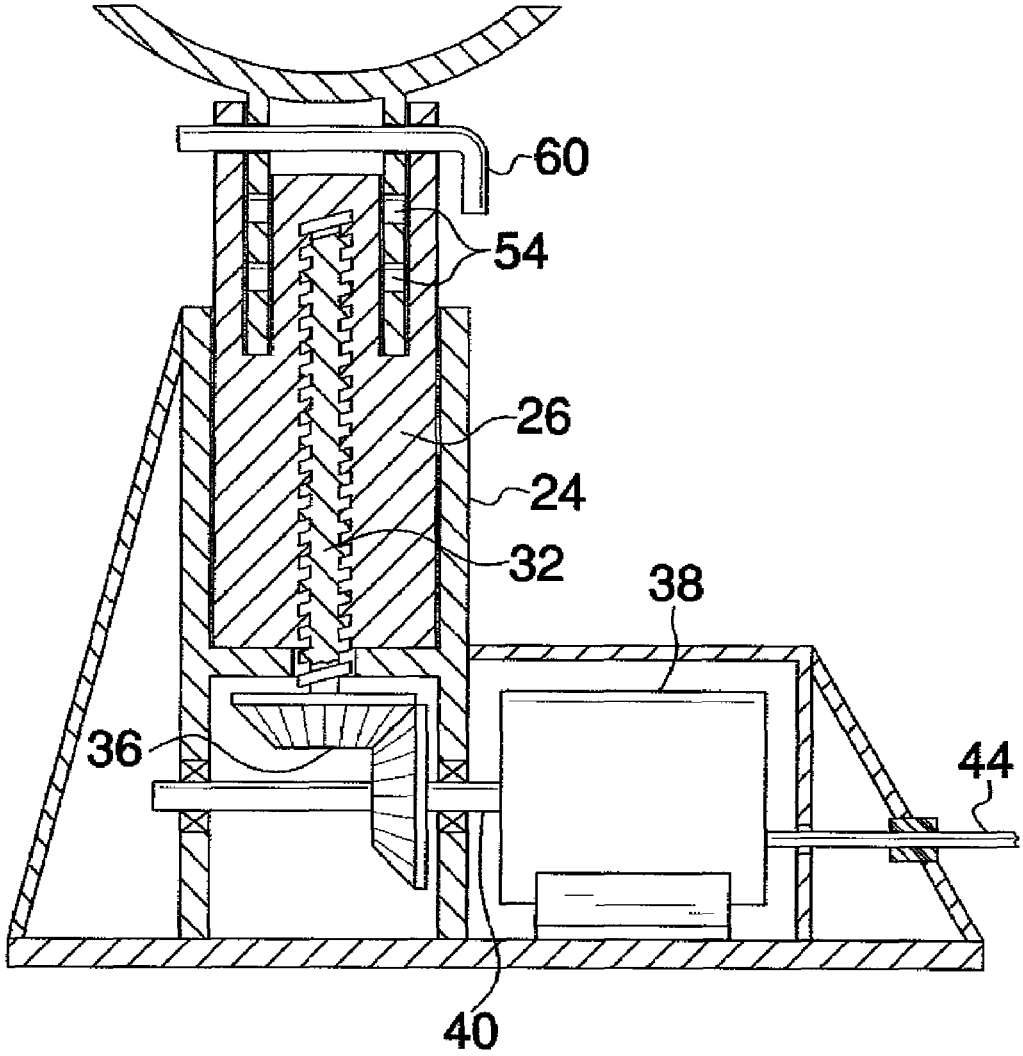
FIG. 3 is a cross-sectional view taken along line 3-3 of FIG. 1 with a piston of the present invention in a lowered position.
Figure 4:
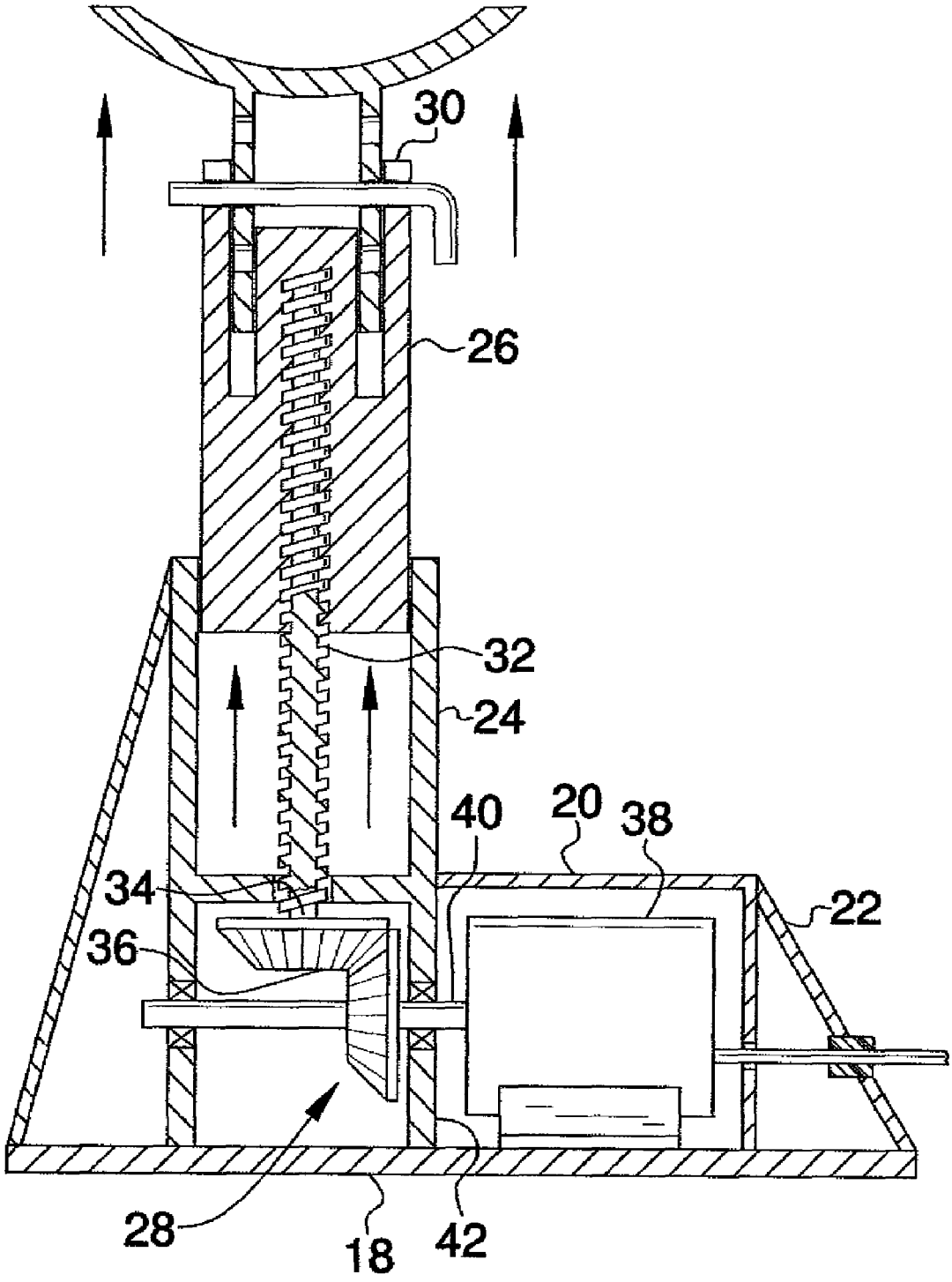
FIG. 4 is a cross-sectional view of the present invention with the piston in a raised position.
Figure 5:
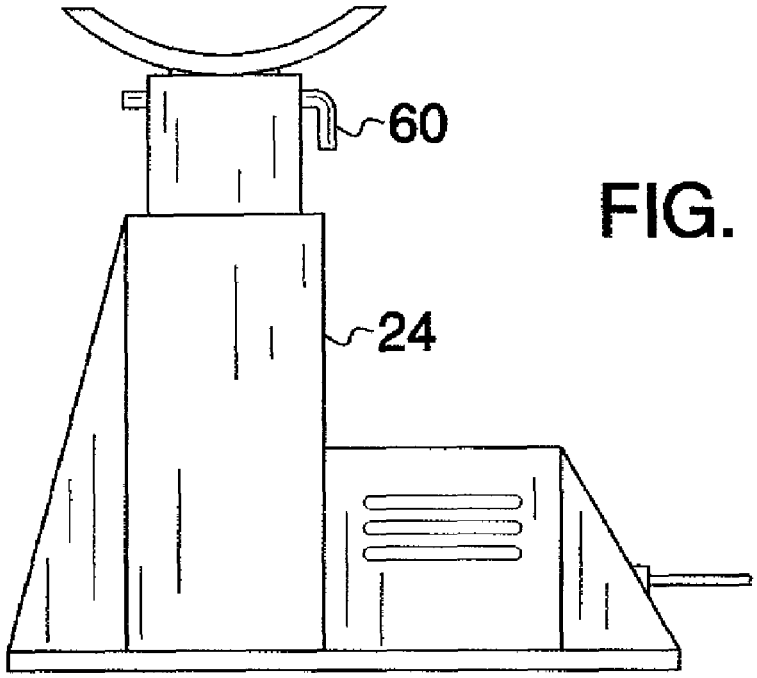
FIG. 5 is a front view of the present invention.
Figure 6:
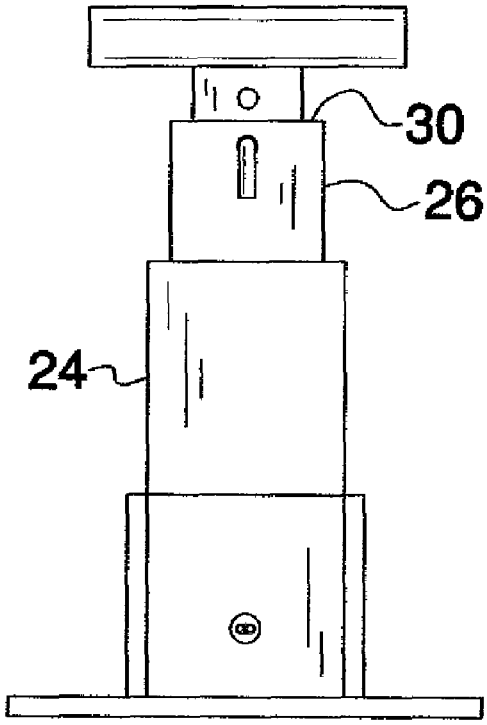
FIG. 6 is a side view of the present invention.
Figure 7:
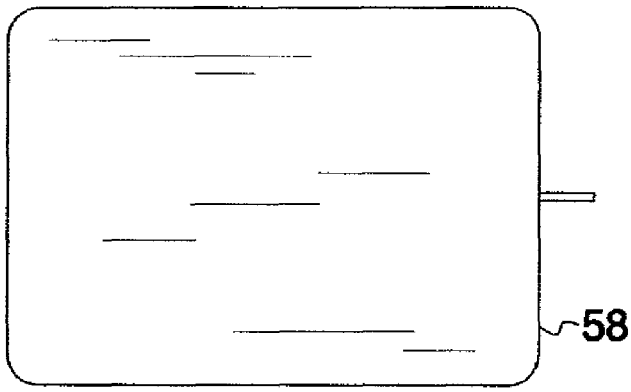
FIG. 7 is a bottom view of the present invention.

With reference now to the drawings, and in particular to FIGS. 1 through 10 thereof, a new vehicle jack device embodying the principles and concepts of the present invention and generally designated by the reference numeral 10 will be described.

As best illustrated in FIGS. 1 through 10, the vehicle lift system 10 generally comprises a vehicle 12 that includes a power supply port 14. A housing 16 has a bottom wall 18, a top wall 20 and a peripheral wall 22 that is attached to and extends between the top 20 and bottom 18 walls. A sleeve 24 is attached to and extends upwardly from the housing 16. A piston 26 is mounted in the sleeve 24. The bottom wall 18 extends outwardly from the peripheral wall 22 to provide additional stability for the housing 16.

A drive assembly 28 is mechanically coupled to the piston 26. The drive assembly 28 is actuated in a first direction to raise an upper end 30 of the piston 26 with respect to the housing 16. The drive assembly 28 is actuated in a second direction to lower the upper end 30 of the piston 26 with respect to the housing 16. The drive assembly 28 is removably coupled to the power supply port 14 to supply electrical power to the drive assembly 28. The drive assembly 28 includes a screw 32 that is threadably coupled to the piston 26. The screw 32 has a bottom end 34 that is positioned within the housing 16. A gear assembly 36 is mechanically coupled to the screw 32. The gear assembly 36 is positioned within the housing 16. A motor 38 is mounted in the housing 16 and a drive shaft 40 is coupled to the motor 38. The motor 38 is actuated to rotate the drive shaft 40 in a first direction or a second direction. The drive shaft 40 is mechanically coupled to the gear assembly 36. A dividing wall 42 divides the motor from the gear assembly 36. A power cord 44 is electrically coupled to the motor 38 and extends through the housing 16. The power cord 44 terminates with a male power port plug 46. An actuator 48 is electrically coupled to the motor 38 and is used to turn the motor 38 on in a first direction or a second direction.

A plurality of engaging members 50 is provided. One of the engaging members 50 is removably attached to the upper end 30 of the piston 26 and engages the vehicle 12. Each of the engaging members 50 includes a connector 52 removably couplable to the upper end 30 and a support 58 abuttable against the vehicle 12 or other object to be lifted. The connector 52 comprises a tube extendable into a slot in the upper end 30. The tube, or connector 52, has a plurality of sets of two aligned apertures 54 therein. The piston 26 has an opening 56 extending therethrough. A locking pin 60 is removably extendable through the opening 56 and an aligned one of the sets of the aligned apertures 54. The support 58 is attached to a top end of the connector 52.

Figure 8:
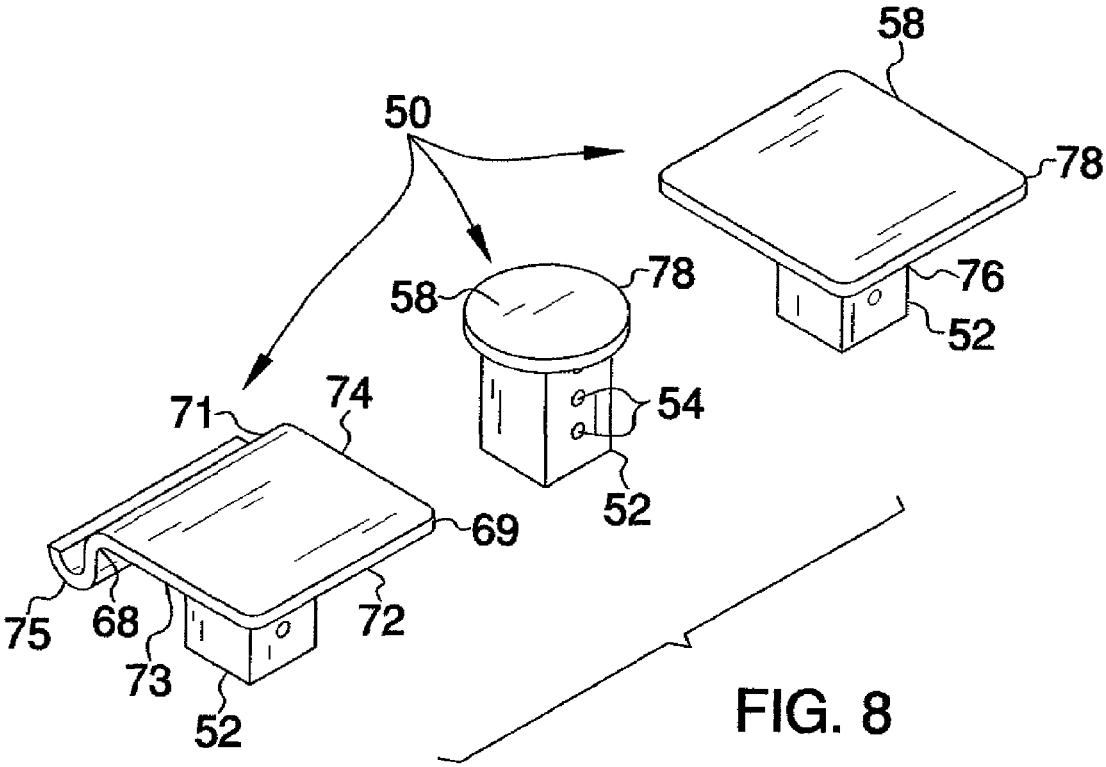
FIG. 8 is a perspective view of a plurality of engaging members of the present invention.
Figure 9:
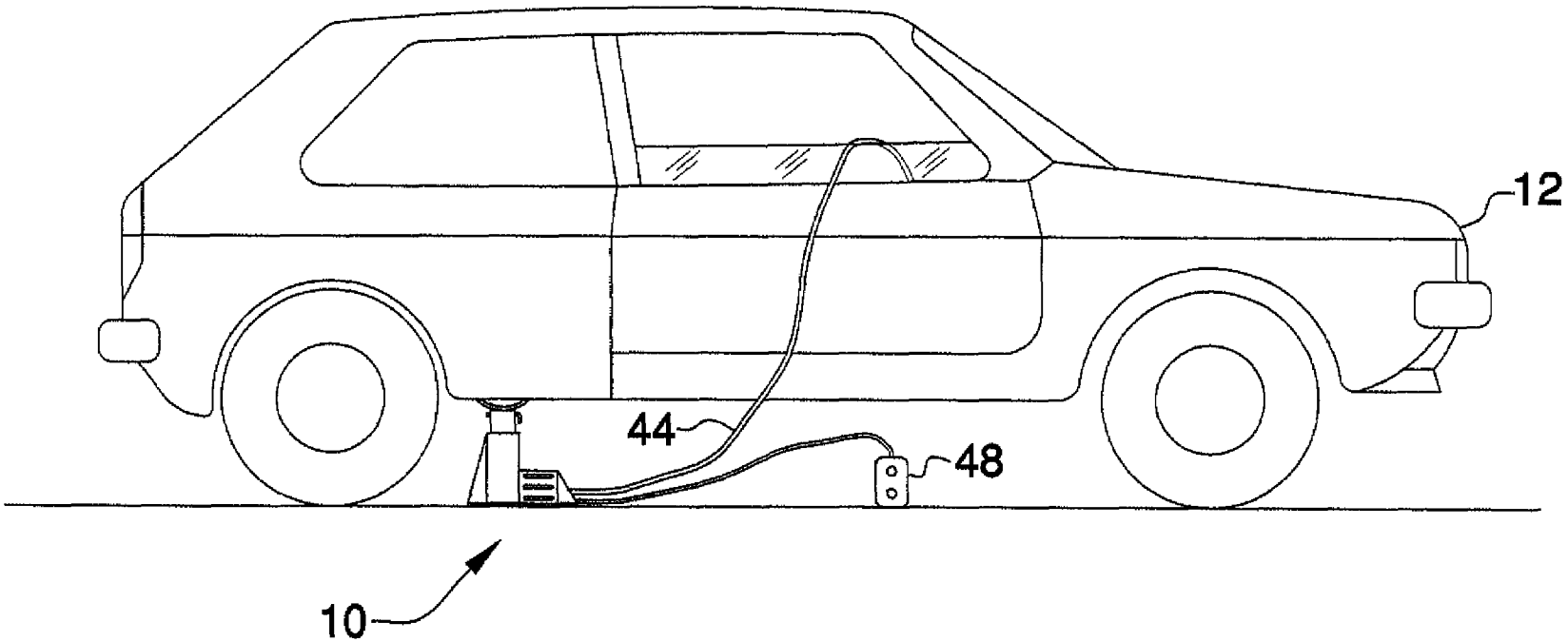
FIG. 9 is an in-use view of the present invention.
Figure 10:
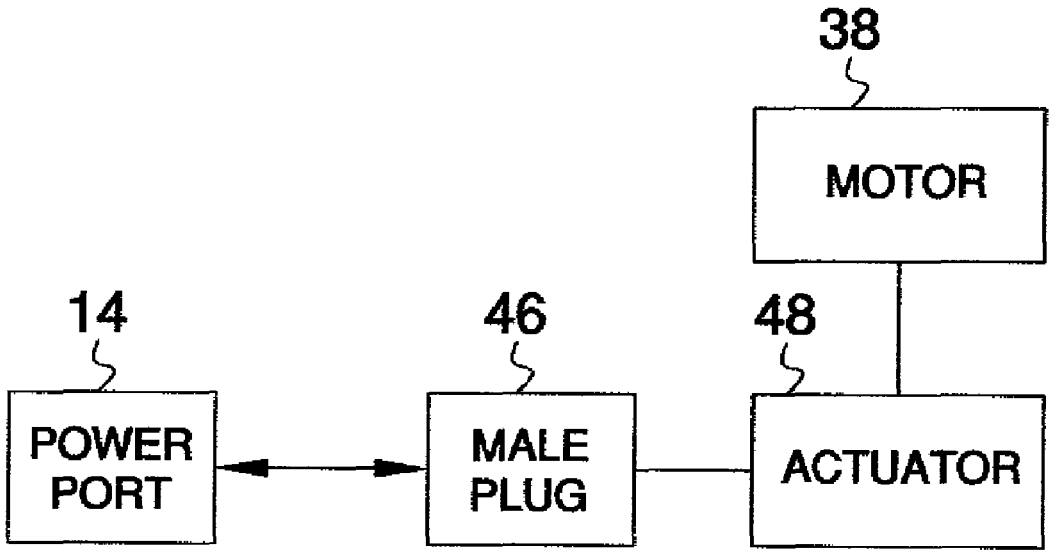
FIG. 10 is an electronic schematic view of the present invention.

The support 58 of a first engaging member 62 of the plurality of engaging members 50 comprises a panel 64 having a first lateral edge 65 and a second lateral edge 66. The panel 64 has an upper surface 67 that is concavely arcuate from the first lateral edge 65 to the second lateral edge 66. The support 58 of a second engaging member 68 comprises a plate 69 that is planer and has a first edge 71, a second edge 72, a third edge 73 and a fourth edge 74. A U-shaped catch 75 is attached to and extends along a length of the first edge 71. The support 58 of a third engaging member 76 of the plurality of engaging members consists of a panel 78 having a planer upper surface. FIG. 8 shows a third engaging member having both a circular or a rectangular shaped panel 78.

In use, one of the engaging members 50 is selected and coupled to the piston 26. The housing 16 is then placed under the vehicle 12 and the plug plugged into the vehicle 12. The piston 26 is then raised to cause a portion of the vehicle 12 to be lifted. After the vehicle 12 is no longer being worked on, such as for a flat tire, the piston 26 is lowered.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A vehicle lifting system comprising:

a vehicle including a power supply port;

a housing having a bottom wall, a top wall and a peripheral wall attached to and extending between said top and bottom walls;

a sleeve being attached to and extending upwardly from said housing;

a piston being mounted in said sleeve;

a drive assembly being mechanically coupled to said piston, said drive assembly being actuated in a first direction to raise an upper end of said piston with respect to said housing, said drive assembly being actuated in a second direction to lower said upper end of said piston with respect to said housing, said drive assembly being removably coupled to said power supply port to supply electrical power to said drive assembly; and a plurality of engaging members, one of said engaging members being removably attached to said upper end of said piston and engaging said vehicle, each of said engaging members including:

a connector removably couplable to said upper end and a support abuttable against said vehicle, said connector comprising a tube extendable into a slot in said upper end; and a support attached to a top end of said connector.

2. The system according to claim 1, wherein said drive assembly includes:

a screw being threadably coupled to said piston, said screw having a bottom end being positioned within said housing;

a gear assembly being mechanically coupled to said screw, said gear assembly being positioned within said housing;

a motor being mounted in said housing, a drive shaft being coupled to said motor, said motor being actuated to rotate said drive shaft in a first direction or a second direction, said drive shaft being mechanically coupled to said gear assembly;

a power cord being electrically coupled to said motor and extending through said housing, said power cord terminating with a male power port plug.

3. The system according to claim 2, wherein said driver assembly further includes an actuator being electrically coupled to said motor and being used to turn said motor on in a first direction or a second direction.

4. The system according to claim 1, wherein each of said engaging members further includes:

said tube having a plurality of a sets of two aligned apertures therein, said piston having an opening extending therethrough, a locking pin being removably extendable through said opening and an aligned one of said sets of said aligned apes.

5. The system according to claim 1, wherein said support of a first engaging member of said plurality of engaging members comprises a panel having a first lateral edge and a second lateral edge, said panel having an upper surface being concavely arcuate from said first lateral edge to said second lateral edge.

6. The system according to claim 5, wherein said support of a second engaging member of said plurality of engaging members comprises a plate, said plate being planer and having a first edge, a second edge, a third edge and a fourth edge, a U-shaped catch being attached to and extending along a length of said first edge.

7. The system according to claim 6, wherein said support of a third engaging member of said plurality of engaging members consists of a panel having a planer upper surface.

8. A vehicle lifting system comprising:

a vehicle including a power supply port;

a housing having a bottom wall, a top wall and a peripheral wall attached to and extending between said top and bottom walls;

a sleeve being attached to and extending upwardly from said housing;

a piston being mounted in said sleeve;

a drive assembly being mechanically coupled to said piston, said drive assembly being actuated in a first direction to raise an upper end of said piston with respect to said housing, said drive assembly being actuated in a second direction to lower said upper end of said piston with respect to said housing, said drive assembly being removably coupled to said power supply port to supply electrical power to said drive assembly, said drive assembly including;

a screw being threadably coupled to said piston, said screw having a bottom end being positioned within said housing;

a gear assembly being mechanically coupled to said screw, said gear assembly being positioned within said housing;

a motor being mounted in said housing, a drive shaft being coupled to said motor, said motor being actuated to rotate said drive shaft in a first direction or a second direction, said drive shaft being mechanically coupled to said gear assembly;

a power cord being electrically coupled to said motor and extending through said housing, said power cord terminating with a male power port plug;

an actuator being electrically coupled to said motor and being used to turn said motor on in a first direction or a second direction;

a plurality of engaging members, one of said engaging members being removably attached to said upper end of said piston and engaging said vehicle, each of said engaging members including;

a connector removably couplable to said upper end and a support abuttable against said vehicle, said connector comprising a tube extendable into a slot in said upper end, said tube having a plurality of a sets of two aligned apertures therein, said piston having an opening extending therethrough, a locking pin being removably extendable through said opening and an aligned one of said sets of said aligned apertures;

a support attached to a top end of said connector;

said support of a first engaging member of said plurality of engaging members comprising a panel having a first lateral edge and a second lateral edge, said panel having an upper surface being concavely arcuate from said first lateral edge to said second lateral edge;

said support of a second engaging member of said plurality of engaging members comprising a plate, said plate being planer and having a first edge, a second edge, a third edge and a fourth edge, a U-shaped catch being attached to and extending along a length of said first edge; and said support of a third engaging member of said plurality of engaging members consisting of a panel having a planer upper surface.

* * * * *